US005860490A

United States Patent [19]

Petti et al.

[11] Patent Number: 5,860,490

[45] Date of Patent: Jan. 19, 1999

[54] MONOPOLE LADDER

[76] Inventors: John A. Petti, 269 Shafer Ave., Philipsburg, N.J. 08865-2416; Donald J. Long, 1925 Ferry St., Easton, Pa. 18042

[21] Appl. No.: 843,861

[22] Filed: Apr. 17, 1997

[51] Int. Cl.[6] ..... E06C 7/00

[52] U.S. Cl. ..... 182/134; 182/221; 182/92

[58] Field of Search ..... 182/134, 135, 182/136, 100, 189, 221, 92; 248/297.51

[56] References Cited

U.S. PATENT DOCUMENTS

| | | | |
|---|---|---|---|
| 917,805 | 4/1909 | Shaw | 182/134 |
| 1,307,468 | 6/1919 | Wells | 182/135 |
| 1,863,756 | 6/1932 | Lufkin . | |
| 2,311,352 | 2/1943 | Seiler | 182/136 |
| 2,330,288 | 9/1943 | Hurley | 182/134 |
| 2,744,674 | 5/1956 | Smith | 182/189 |
| 3,403,750 | 10/1968 | Pomagaslki . | |
| 4,061,202 | 12/1977 | Campbell | 182/100 |
| 4,301,891 | 11/1981 | Harbian . | |
| 4,310,070 | 1/1982 | Mastrogiannis . | |
| 4,754,841 | 7/1988 | Koffski | 182/100 |
| 4,787,476 | 11/1988 | Lee | 182/116 |
| 4,892,170 | 1/1990 | O'Donnell . | |
| 5,253,732 | 10/1993 | Daniels | 182/100 |

FOREIGN PATENT DOCUMENTS

| | | | |
|---|---|---|---|
| 27495 | 12/1907 | United Kingdom | 248/297.5 |

*Primary Examiner*—Alvin Chin-Shue
*Attorney, Agent, or Firm*—Terrance L. Siemens

[57] ABSTRACT

An ascending and descending device, or ladder, having a single central mast and a hand and two foot supports axially slidably engaging the mast. Each hand and foot support has a spring biased clutch normally preventing axial motion of its associated support along the mast, and a lever for releasing the hand or foot support to move along the mast. The hand support has weight bearing platforms, or grips, projecting to both sides of the mast. Each foot support projects to one side of the mast. The foot supports are tethered together to limit the distance by which they become separated when lowering one foot support. The mast has at its bottom end a base having folding legs. The mast selectively receives at its top end a pronged support for engaging the roof of a building and a chair to enable a person to remain seated above the ground. The chair has a safety tie for securing the chair to a tree.

5 Claims, 3 Drawing Sheets

MONOPOLE LADDER

BACKGROUND OF THE INVENTION

1. Field of the Invention

The present invention relates to ladders and climbing devices. More particularly, the invention comprises a climbing and descending device having a single central mast and two steps which slide upwardly and downwardly along the mast. Each step has a one-way clutch preventing sliding, so that the two steps may be alternately moved upwardly in a ratcheting scheme. The clutch can be released for enabling the steps to descend. The steps are tethered so that descent during one motion of each step is limited.

2. Description of the Prior Art

Alternatives for conventional ladders having right and left lateral rails and spaced apart rungs spanning the rails are known in the prior art. Included among these alternative ladders are those having a single central vertical pole and associated foot supports. These alternative ladders may serve a specific application or may be intended as more compact general purpose ladders. Among the principal applications of alternative ladders are their adaptability to irregular objects and terrain. For example, monopole ladders for climbing trees and geographic formations have been proposed in the prior art.

U.S. Pat. No. 4,301,891, issued to Jivan Harbian on Nov. 24, 1981, describes a monopole climbing device wherein elements for supporting hands and feet are clutched to the pole. However, foot support elements and hand support elements are provided in unitary paired assemblies causing both feet to be supported at a common elevation along the pole. Similarly, both hands are supported at a second common elevation along the pole. No hand or foot support element is tethered to a second similar element in the manner of the present invention. Further, Harbian causes individual hand and foot support elements to encircle the pole in a non-rotatable manner, vertical sliding being opposed by a separate lever actuated brake. In the present invention, a single common spring biased mechanism prevents both vertical movement relative to the pole and also binds the foot support element to the pole.

U.S. Pat. No. 4,310,070, issued to Spirodon Mastrogiannis on Jan. 12, 1982, describes a monopole climbing device having separate foot supporting elements. Pivoting of each foot supporting element clutches the foot supporting element to the pole by frictionally engaging a guide cable extending along the pole. However, the clutching arrangement of Mastrogiannis is different from that of the present invention, and Mastrogiannis also lacks tethers tethering two foot supporting elements to one another for limiting separation or displacement between the two.

U.S. Pat. No. 3,403,750, issued to Jean Pomagalski on Oct. 1, 1968, describes a monopole lift essentially employing a cable and pulley supported seat. Although this device has a footrest, the two feet are supported by a unitary member. By contrast, the present invention has two independent foot supports which move alternately up and down the pole, the foot supports being tethered to limit separation or displacement from one another. Pomagalski's device lacks the one way clutch enabling ratcheting ascent of the present invention.

U.S. Pat. No. 4,892,170, issued to William P. O'Donnell on Jan. 9, 1990, describes a portable monopole ladder having rungs extending laterally from a central pole. The rungs are employed in generally conventional fashion, there being no foot supports axially slidable along the central pole, nor tethers for tethering foot supports to one another.

None of the above inventions and patents, taken either singly or in combination, is seen to describe the instant invention as claimed.

SUMMARY OF THE INVENTION

The present invention provides a monopole ladder having a central mast to which two foot supports and a hand support are engaged. The foot and hand supports are axially slidable relative to the mast. Each hand or foot support has a clutch mechanism which normally prevents axial movement when weight is imposed thereon, and slides with little resistance along the mast when a release lever is depressed. The release lever is spring biased into an engaging condition wherein axial motion is opposed. The monopole ladder further includes a folding base for steadying the monopole ladder on the ground or other horizontal surface and optional removably attached accessories mountable to the top of the mast. One accessory is a two pronged support, which may be propped on a roof or similar surface for steadying the novel monopole ladder. Another accessory is a seat which enables a hunter to be seated while the monopole ladder is propped against a tree. A tie cable is provided for securing the upper end of the mast to the tree.

Each foot support is tethered to the other so that separation or displacement of one foot support relative to the other is limited to a predetermined distance. This feature prevents loss of control while descending with the release lever of one foot support in the release condition.

The mast preferably comprises square tubing, so that neither the hand support nor the foot supports can rotate out of their previous positions relative to vertical registry. The mast is formed in nesting sections so that it is adjustably extended in length. Optional accessories are connected to the mast in the same way as sections of the mast.

Accordingly, it is a principal object of the invention to provide a monopole ladder having a central mast and axially movable hand and foot supports mounted to the mast.

It is another object of the invention to provide a clutch mechanism for releasing hand and foot supports to slide axially along the mast.

It is a further object of the invention that the clutch mechanism normally maintain the hand and foot supports in an engaged condition preventing axial movement along the mast.

Still another object of the invention is to tether the foot supports together to limit separation between the two when descending.

An additional object of the invention is to provide a removable seat and a removable support for engaging a roof of a building, each of which is attachable to the top of the mast.

It is again an object of the invention to provide a folding base for steadying the novel monopole ladder on a horizontal surface.

Yet another object of the invention is that the monopole ladder be adjustable as to length.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
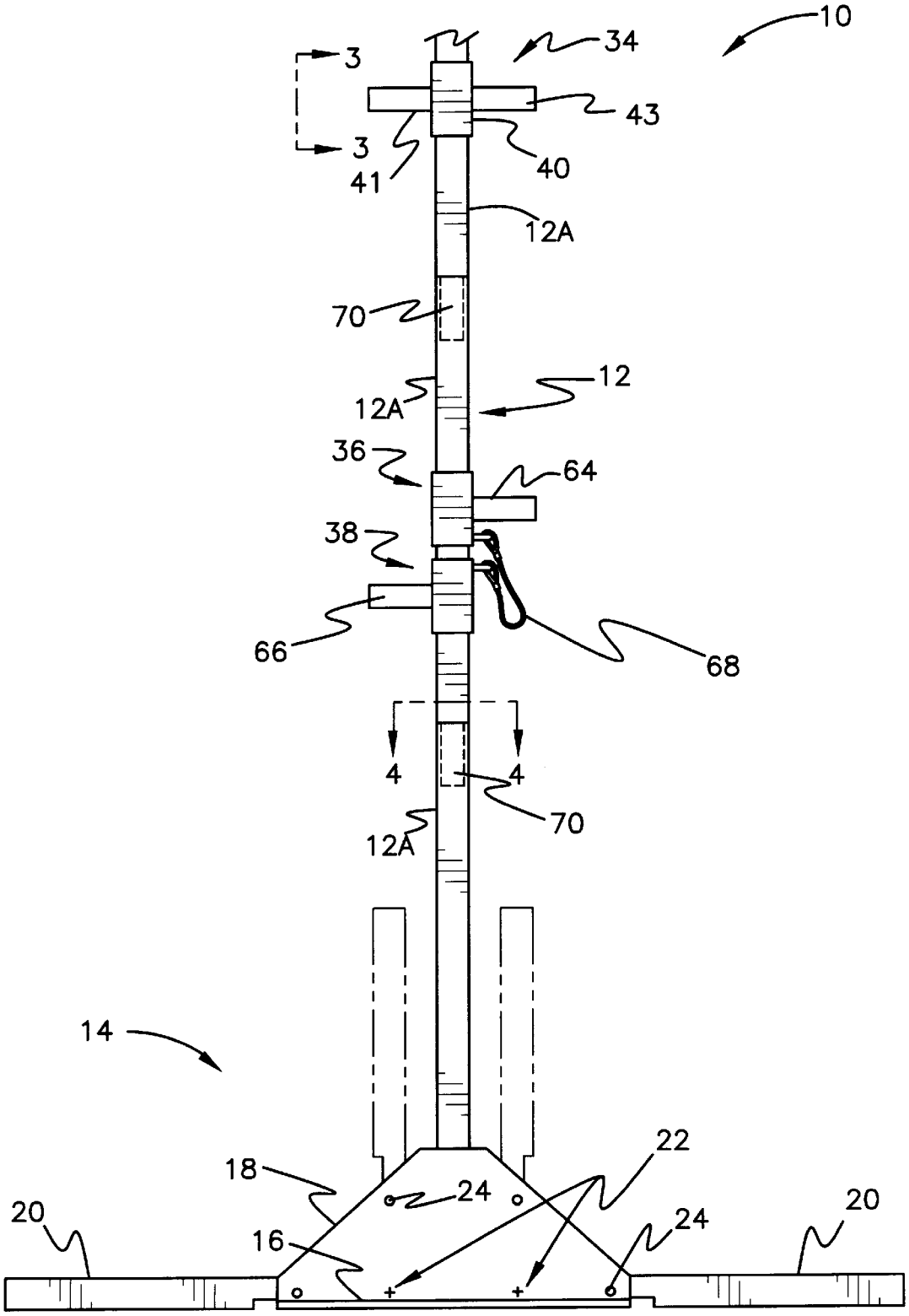
FIG. 1 is a side elevational view of the invention.

Turning now to FIG. 1 of the drawings, novel monopole ladder or ascending and descending device 10 is shown in a vertical, erect condition appropriate for vertical ascent and descent. Device 10 has a monopole or central mast 12 supported on a horizontal environmental surface (not shown) on a base 14. Base 14 comprises a base plate 16, one or more gusset plates 18, and a plurality of legs 20 pivotally connected to base 14. Legs 20 are movable between a stowed position shown in broken lines wherein legs 20 are parallel to and proximate mast 12 and a deployed position wherein legs 20 extend perpendicularly to mast 12. Each leg 20 is hinged at 22 to pivot into the stowed and deployed positions.

Figure 2:
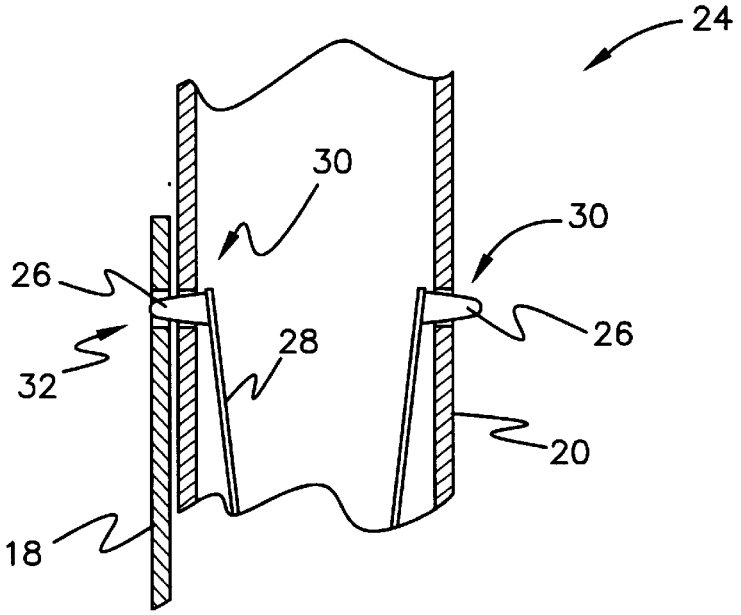
FIG. 2 is a side elevational, partially cross sectional detail view taken from the lower portion of FIG. 1.

Shown in greater detail in FIG. 2, each leg 20 has displaceable spring biased locking arrangement 24 for locking the leg 20 in the deployed position. Each locking arrangement 24 includes a projection 26 mounted on a spring arm 28. Preferably, spring arm 28 is bent into the shape of a "V" to serve two opposed projections 6. Arm 28 and projections 26 are disposed inside associated leg 20, which has openings 30 for enabling projections 26 to engage corresponding openings 32 (only one shown) formed in gusset plate 18. Normally, legs 20 will resist spontaneous disengagement from locking arrangement 24, although projections 26 are dimensioned and configured so that hand pressure will urge projections 26 to retract, thereby enabling disengagement so that legs 20 may be moved between stowed and deployed positions. Preferably, similar locking arrangements 24 are provided for securing legs 20 in the stowed position.

Returning to FIG. 1, device 10 has support members for bearing the weight of a user as he or she ascends and descends. These support members include a hand support member 34, a first foot support member 36, and a second foot support member 38. Each support member 34, 36, or 38 slidably engaging mast 12 so as to move axially therealong.

Figure 3:
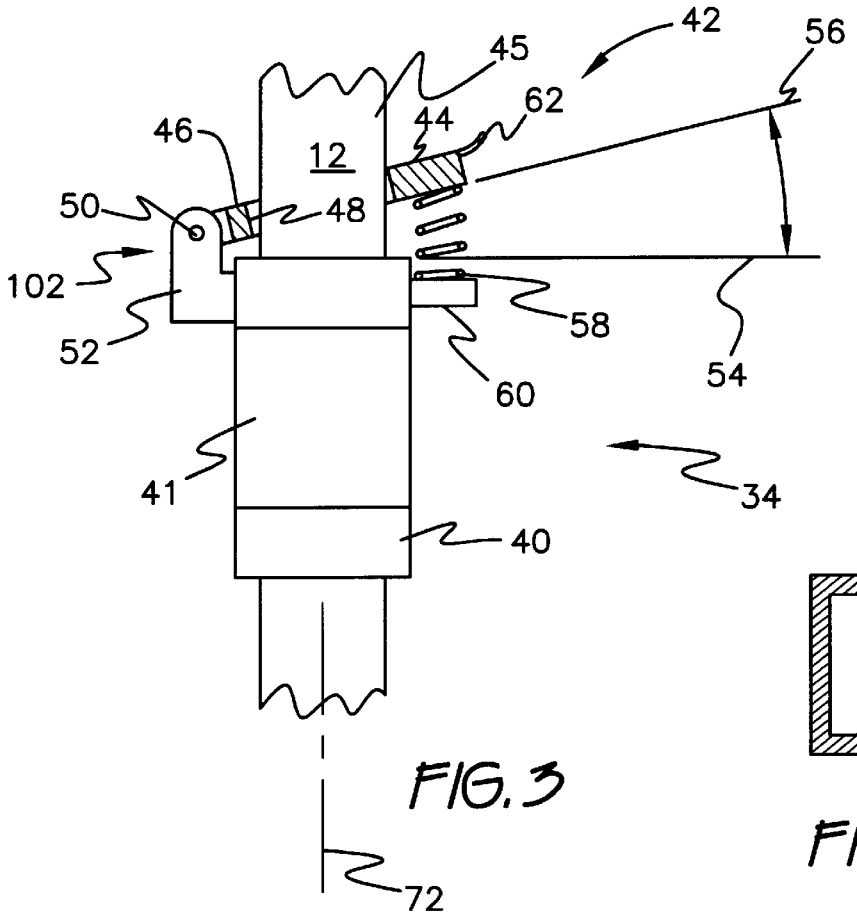
FIG. 3 is a side elevational, partially cross sectional detail view taken along line 3—3 of FIG. 1.

Common construction of support members 34, 36, and 38 is shown in FIG. 3. FIG. 3 illustrates member 34, but construction and operative principles are equally applicable to foot support members 36, 38. Support member 34 has a collar or engagement member 40 encircling mast 12. A weight bearing member or platform 41 projects laterally from one side of engagement member 40. As shown in FIG. 1, a second platform 43 projects laterally from the other side of engagement member 40. Platforms 41, 43 provide hand holds for the user.

Again referring to FIG. 3, support member 34 has a clutch mechanism normally constraining support member 34 against moving axially along mast 12. The clutch mechanism has a release element enabling support member 34 to move axially along mast 12. The clutch mechanism includes a tiltable member 42 comprising a front arm 44, a rear arm 46, and an opening 48 formed between front arm 44 and rear arm 46. Mast 12 passes through opening 48, which opening 48 is large enough to accommodate passage of mast 12, but will contact and bind against mast 12 at the inner surfaces of arms 44 and 46 when tiltable member 42 is inclined.

Tiltable member 42 is pivotally attached to engagement member 40 by an axle 50 journaled within a boss 52 fixed to engagement member 40. Tiltable member 42 can pivot between an engaged position wherein tiltable member 42 bindingly engages mast 12 and a released position wherein tiltable member 42 is free of binding engagement with mast 10. FIG. 3 illustrates tiltable member 42 in the engaged position. The released position is indicated by line 54. Line 54 represents the position which would be assumed by center line 56 of tiltable member 42 when tiltable member 42 is in the released position. If mast 12 and engagement member 42 are fabricated from materials of suitable friction characteristics, then face 45 of mast 12 engaged by arm 44 in the engaged position may be planar. Optionally, face 45 may bear grooves (not shown), texturing (not shown) inscribed or abraded into face 45, or a coating of a friction imparting material (not shown) to assure effective binding engagement of the inner surface of arm 44 with mast 12 in the engaged position.

Engagement member is normally urged into the engaged position by a coil spring 58 exerting compressive force against engagement member 42. Spring 58 is retained by entrapment at its distal end by being fixed to a spring keeper 60 and at its proximal end by interference with and suitable retaining structure (not shown in detail) formed as part of engagement member 42. Force of spring 58 is overcome by manual pressure exerted downwardly on engagement member 42 at arm 44. A handle 62 is optionally provided for ready grasping of engagement member 42 and depressing the same into the released position.

Again referring to FIG. 1, platforms 41 and 43 are intended to bear weight of the user by grasping by hand. Corresponding support of the feet of the user is provided by platform 64 of foot support member 36 and platform 66 of foot support member 38. Hand support member 34 accommodates grasping by either hand or both since platforms 41 and 43 project in opposite directions from mast 12. To accommodate alternating stepping by the feet, each foot support member 36 or 38 is arranged so that its associated platform 64 or 66 projects in an opposite direction from that of the other platform 66 or 64. Directions of projection of platform 41 is similar to that of platform 66, and direction of projection of platform 43 is similar to that of platform 64.

Foot support members 36, 38 are connected by a tether 68 of predetermined length, wherein the proximal end of tether 68 is fastened to one support member 36 or 38 and the distal end is fastened to adjacent support member 38 or 36. This arrangement constrains support members 36 and 38 to be constrained against being separated from one another by a distance greater than said predetermined length. It is preferred that tether 68 not exceed sixteen inches in overall length.

Mast 12 is formed from plural nesting, separable members 12A, whereby effective length of mast 12 is adjustable. Each member 12A has an open upper end and a peg 70 disposed at the lower end. Peg 70 is dimensioned and configured to cooperate closely with the upper open end, so that any number of members 12A may be inserted into and removed from the open end of an adjacent member 12A.

Figure 4:
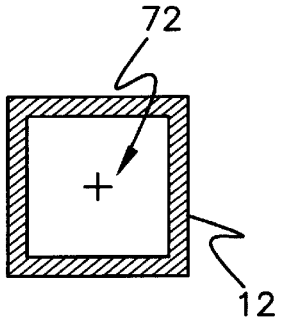
FIG. 4 is a cross sectional detail view taken along line 4—4 of FIG. 1.

As seen in FIG. 4, mast 12 is formed from square tubing. The constituent stock material of mast 12 may be other than square, provided that it is other than circular. This characteristic assures that mast 12 and its constituent members 12A are radially asymmetrical about the longitudinal axis 72 (also see FIG. 3) of mast 12. Thus, any one support member 34, 36, or 38 is constrained against rotating out of common alignment with other support members 34, 36, 38 is prevented. Also, rotation of one support member responsive to gravity when mast 12 is inclined from the vertical is also prevented.

Figure 5:
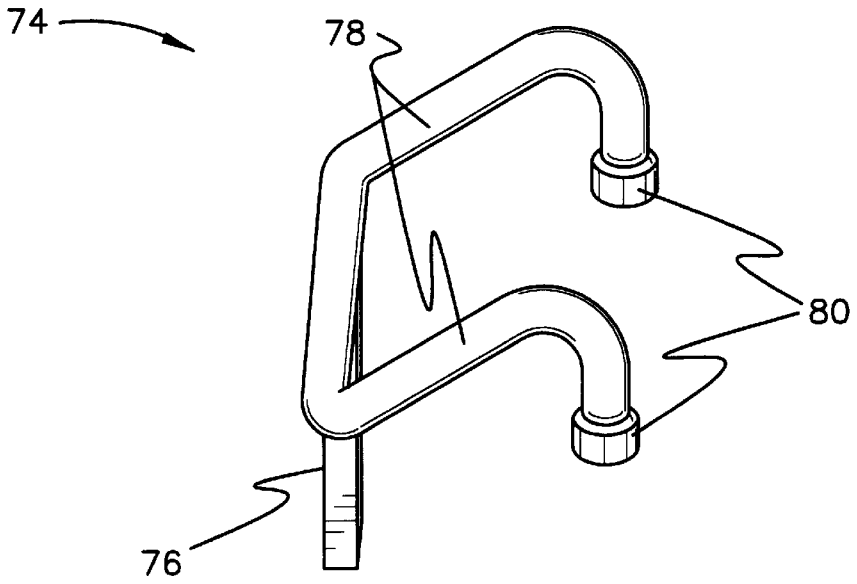
FIG. 5 is a perspective view of a component insertable into and removably retained within the novel device from the top.

It will be appreciated that when assembled, mast 12 of novel device 10 has an open end accessible from the top. This open end may be utilized to accommodate several optional items. As shown in FIG. 5, one option comprises a removable propping support 74 for propping device 10 against the roof of a building (not shown) or against a similar surface. Propping support 74 has a peg 76 for nestably engaging mast 12 by occupying the otherwise idle open end of mast 12. Propping support 74 has two prongs 78 which will project away from support members 34, 36, 38 (see FIG. 1) of device 10 when propping support 74 is installed onto mast 12. As employed herein, reference to prongs 78 as projecting away from support members 34, 36, 38 signifies that prongs 78 will be disposed on a side of mast 12 opposite that of handle 62 (see FIG. 3) or equivalent apparatus for releasing the clutch mechanism of each support member 34, 36, or 38. Prongs 78 have feet 80 disposed parallel to one another, in order to stably engage the roof or equivalent surface.

Figure 6:
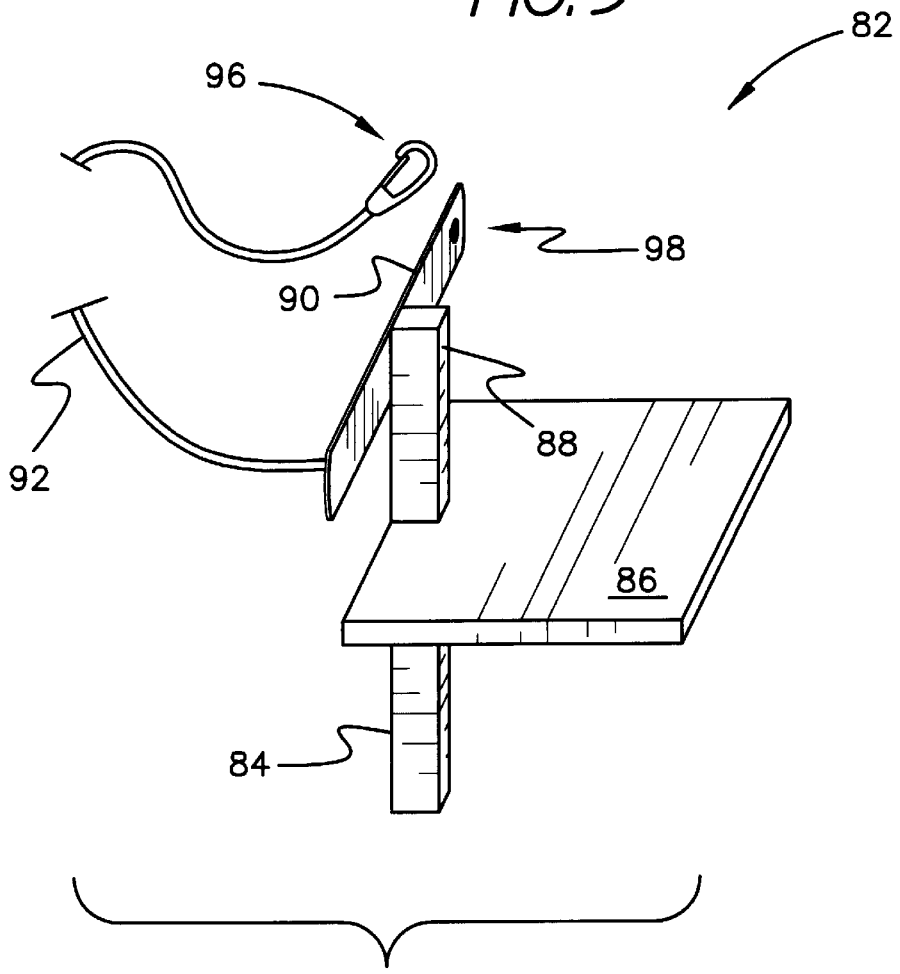
FIG. 6 is a perspective view of a second component insertable into and removably retained within the novel device from the top.

FIG. 6 shows a second optional device which may be removably installed in the exposed open upper end of mast 12, this being a chair 82. Chair 82 includes a peg 84 for nestably engaging the open end of mast 12 and a seating surface 86 disposed perpendicularly to mast 12 when chair 82 is installed thereto. Peg 84 has an upward extension 88 supporting a member 90 to which a safety tie 92 is fastened at 94. Safety tie 92 has a snap hook 96 which engages a hole 98 for fastening. Safety tie 92 may be passed around an environmental object such as a tree (not shown) and fastened to chair 82 to secure chair 82 to the environmental object. This is a useful feature for hunters who wish to occupy a vantage point well above the ground without being obliged to expend undue effort in climbing a tree and securing a seat to the same.

The present invention is subject to modifications and variations which may be introduced without departing from the inventive concept. For example, snap hook 96 may be replaced by a buckle or other releasable fastener capable of adjusting effective length of safety tie 92.

In further examples, engagement member 42 need not fully encircle mast 12, although full encirclement will result in sturdier construction of engagement member 42. Foot support members 36, 38 may, if desired, be modified to include additional platforms in the manner of hand support member 34. Locking arrangements 24 may utilize pins (not shown) inserted entirely through legs 20 and gusset plates 18 for more secure engagement.

It is to be understood that the present invention is not limited to the embodiments described above, but encompasses any and all embodiments within the scope of the following claims.

We claim:

1. A climbing apparatus comprising:

a central mast having a generally rectangular cross section including a front side and a rear side opposite one another;

a plurality of weight bearing support members comprising a handle where two oppositely disposed grips extend laterally from said engagement member and a first and a second foot platform where first said foot plan form has a weight bearing platform extending from said enga ment member in a first direction and where said second foot platform has a weight bearing member extending from said engagement member in a second direction and where said first direction and said second direction are opposite to one another, and where each said weight bearing support member further includes a clutch mechanism comprising an inclinable member pivotably attached to said engagement member proximate said rear side of said central mast, said clutch further comprising a spring disposed entirely on said front side of said central mast, said spring having a first end fixed to said engagement member proximate said front side of said central mast and said spring having a second end attached to said inclinable member proximate said front side of said central mast, said inclinable member disposed to substantially surround said central mast such that said spring urges said inclinable member to bindingly engage said central mast; and a removable chair engageable with the top of said central mast, said removable chair comprising a peg and a seating surface disposed perpendicularly to said central mast and said peg, said peg being inserted into a central opening in the top of said central mast; whereby at rest, said spring holds each said inclinable member in a first, locked position that bindingly engages said central mast and when said spring is compressed, each said inclinable member is placed in a second, unlocked position where said weight bearing support members, through said engagement members, are free to move axially along said central mast.

2. The climbing apparatus according to claim 1, further including a tether of predetermined length attached to both said first and said second foot platforms whereby both said connected support members are constrained in their axial movement along said central mast with regard to one another by the length of said tether.

3. The climbing apparatus according to claim 1, wherein said central mast is comprised of nesting, separable members to allow for adjustability.

4. The climbing apparatus according to claim 1, wherein said central mast includes a base having a plurality of legs pivotally connected thereto, said legs being movable between a stowed position where said legs are generally parallel to and proximate said central mast, and a deployed position where said legs extend perpendicularly from said central mast and where each said leg includes locking means for securing said leg in said deployed position.

5. The climbing apparatus according to claim 1, further including a safety tie having a first end attached to said chair and having a second end including a fastener adapted to engage said chair, such that said safety tie may be passed around an environmental object to secure said removable chair to the environmental object.

* * * * *